US010871354B2

(12) United States Patent
Amendola et al.

(10) Patent No.: US 10,871,354 B2
(45) Date of Patent: Dec. 22, 2020

(54) VIBRATION RESISTANT INITIATOR ASSEMBLY HAVING EXPLODING FOIL INITIATOR

(71) Applicant: Reynolds Systems, Inc., Middletown, CA (US)

(72) Inventors: Michael A. Amendola, Middletown, CA (US); Richard K. Reynolds, Calistoga, CA (US); Christopher J. Nance, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 16/705,715

(22) Filed: Dec. 6, 2019

(65) Prior Publication Data

US 2020/0109927 A1 Apr. 9, 2020

Related U.S. Application Data

(62) Division of application No. 15/600,893, filed on May 22, 2017, now Pat. No. 10,557,692.

(51) Int. Cl.

| | |
|---|---|
| ***F42B 3/10*** | (2006.01) |
| ***F42B 3/12*** | (2006.01) |
| ***F42B 3/195*** | (2006.01) |

(52) U.S. Cl.

CPC ..... *F42B 3/10* (2013.01); *F42B 3/12* (2013.01); *F42B 3/128* (2013.01); *F42B 3/195* (2013.01)

(58) Field of Classification Search

CPC .... F42B 3/10; F42B 3/12; F42B 3/125; F42B 3/128; F42B 3/195

USPC .... 102/202.5–202.9, 202.11, 202.14, 275.11

See application file for complete search history.

(56) References Cited

U.S. PATENT DOCUMENTS

| | | | | |
|---|---|---|---|---|
| 5,175,390 | A | 12/1992 | Peretz et al. | |
| 5,431,101 | A * | 7/1995 | Arrell, Jr. | F42B 3/195 102/202.14 |
| 6,851,370 | B2 | 2/2005 | Reynolds et al. | |
| 6,923,122 | B2 | 8/2005 | Hennings et al. | |
| 7,040,234 | B1 * | 5/2006 | Maurer | F42C 15/184 102/200 |
| 7,430,963 | B2 | 10/2008 | Hennings et al. | |
| 7,571,679 | B2 | 8/2009 | Nance | |
| 7,661,362 | B2 | 2/2010 | Hennings et al. | |
| 7,690,303 | B2 | 4/2010 | Reynolds et al. | |

(Continued)

*Primary Examiner* — Bret Hayes

(74) *Attorney, Agent, or Firm* — Burris Law, PLLC

(57) ABSTRACT

An initiator assembly that includes a housing assembly, an exploding foil initiator, an input charge and an output charge. The housing assembly defines a first cavity, a second cavity, and a bulkhead member between the first and second cavities. The exploding foil initiator is received in the housing assembly and includes a bridge, a flyer and a barrel. The flyer overlies the bridge and is disposed between the barrel and the bridge. The barrel defines a barrel aperture. The input charge, which is formed of a secondary explosive, is received in the housing assembly and is disposed in-line with the barrel aperture. The output charge assembly is received in the housing assembly and is formed of a secondary explosive. Energy released from detonation of the input charge in response to operation of the exploding foil initiator penetrates the bulkhead and initiates detonation of the output charge.

13 Claims, 7 Drawing Sheets

(56) References Cited

U.S. PATENT DOCUMENTS

| | | | | |
|---|---|---|---|---|
| 7,866,264 | B2 * | 1/2011 | Nance | F42B 3/13 102/202.14 |
| 7,987,787 | B1 | 8/2011 | Sudick | |
| 8,100,043 | B1 | 1/2012 | Nance et al. | |
| 8,276,516 | B1 | 10/2012 | Nance et al. | |
| 8,408,131 | B1 | 4/2013 | Nance | |
| 8,485,097 | B1 | 7/2013 | Nance et al. | |
| 8,573,122 | B1 | 11/2013 | Nance et al. | |
| 8,726,808 | B1 | 5/2014 | Nance | |
| 9,038,538 | B1 | 5/2015 | Nance et al. | |
| 9,410,784 | B1 * | 8/2016 | Nance | F42C 19/0819 |
| 9,500,448 | B1 | 11/2016 | Nance et al. | |
| 10,267,605 | B1 | 11/2019 | Meadows | |
| 10,557,692 | B1 * | 2/2020 | Amendola | F42B 3/10 |
| 2006/0137559 | A1 * | 6/2006 | Mavrakis | F42C 19/06 102/202.12 |
| 2010/0181748 | A1 * | 7/2010 | Nakamura | F42B 3/103 280/741 |
| 2015/0219428 | A1 * | 8/2015 | Carpenter | F42B 3/124 102/202.7 |

* cited by examiner

VIBRATION RESISTANT INITIATOR ASSEMBLY HAVING EXPLODING FOIL INITIATOR

CROSS-REFERENCE TO RELATED APPLICATIONS

This application is a divisional application of U.S. Ser. No. 15/600,893 filed May 22, 2017, the disclosure of which is incorporated by reference as if fully set forth in detail herein.

FIELD

The present disclosure relates to a vibration resistant initiator assembly having an exploding foil initiator.

BACKGROUND

This section provides background information related to the present disclosure which is not necessarily prior art.

Initiator assemblies are employed to detonate an input charge to release energy that is subsequently employed to initiate detonation, deflagration or combustion in an output charge. There is a trend in the field of initiator assemblies to employ an exploding foil initiator as the means for initiating detonation of the input charge. Electrical energy input to an exploding foil initiator causes a thin metal bridge to vaporize, which propels a flyer through a barrel and into contact with the input charge. The flyer is typically formed of a relatively thin plastic material and must be accelerated over a relatively short distance (i.e., less than 0.050 inch) to a velocity that is sufficient to initiate the detonation of the input charge. Moreover, the flyer must strike the input charge in a manner that is perpendicular to the axis of the barrel to reduce the risk that contact between the flyer and the input charge will initiate detonation of the input charge.

In situations where the initiator assembly is subjected to a relatively large amount of vibration, there is a risk that portions of the output charge will break apart and migrate within the initiator assembly onto the flyer. This situation is detrimental because it greatly increases the risk that the exploding foil initiator will not be able to detonate the input charge. In this regard, if even a relatively small mass of the material that forms the output charge falls onto the flyer, the additional mass could prevent the flyer from being accelerated to a threshold velocity that is needed to cause the input charge to detonate and/or could cause the flyer to tilt relative to the longitudinal axis of the barrel so that the shock produced by contact between the flyer and the input charge is distributed over time (rather than all at once) so that the input charge is not shocked to a degree that initiates detonation of the input charge.

SUMMARY

This section provides a general summary of the disclosure, and is not a comprehensive disclosure of its full scope or all of its features.

In one form, the present teachings provide an initiator assembly that includes a housing, an exploding foil initiator, an input charge and an output charge. The housing assembly defines an interior cavity. The exploding foil initiator is received in the interior cavity and includes a bridge, a flyer and a barrel. The flyer overlies the bridge and is disposed between the barrel and the bridge. The barrel defines a barrel aperture. The input charge, which is formed of a secondary explosive, is received in the interior cavity and is disposed in-line with the barrel aperture. The output charge assembly is received in the interior cavity and is disposed in-line with the input charge on a side of the input charge that faces away from the exploding foil initiator. The output charge assembly has an output charge and a container. The output charge is formed of a secondary explosive. The container defines a closed volume into which the output charge is received.

In another form, the present teachings provide an initiator assembly that includes a housing assembly, an exploding foil initiator, an input charge and an output charge. The housing assembly defines a first cavity, a second cavity, and a bulkhead member between the first and second cavities. The exploding foil initiator is received in the housing assembly and includes a bridge, a flyer and a barrel. The flyer overlies the bridge and is disposed between the barrel and the bridge. The barrel defines a barrel aperture. The input charge, which is formed of a secondary explosive, is received in the housing assembly and is disposed in-line with the barrel aperture. The output charge assembly is received in the housing assembly and is formed of a secondary explosive. Energy released from detonation of the input charge in response to operation of the exploding foil initiator penetrates the bulkhead and initiates detonation of the output charge.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
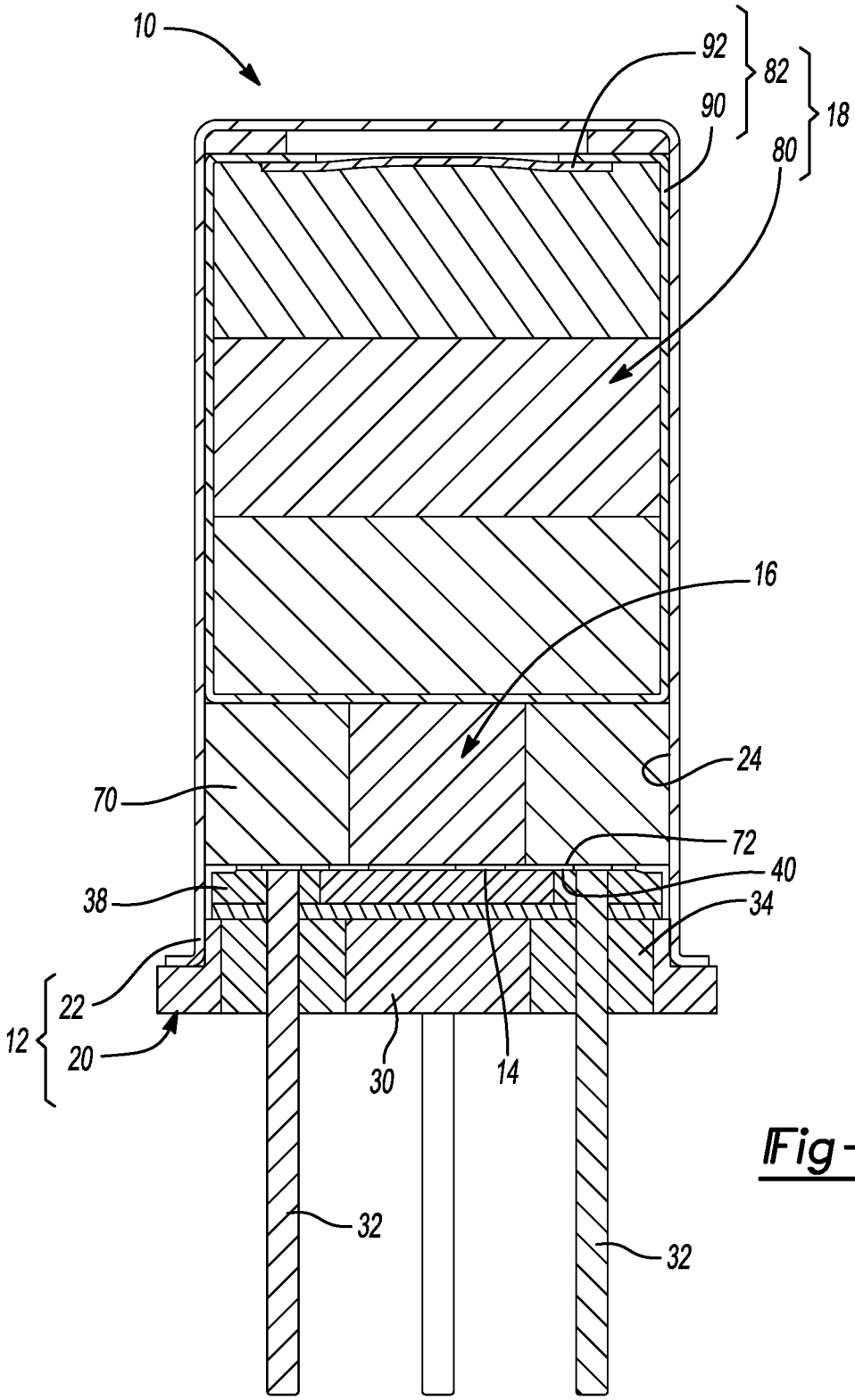
FIG. 1 is a longitudinal section view of a first initiator assembly constructed in accordance with the teachings of the present disclosure.

With reference to FIG. 1 of the drawings, an exemplary initiator assembly constructed in accordance with the teachings of the present disclosure is generally indicated by reference numeral 10. The initiator assembly 10 can include a housing assembly 12, an exploding foil initiator 14, an input charge 16 and an output charge assembly 18. The housing assembly 12, the exploding foil initiator 14 and the input charge 16 can be generally similar to those described in U.S. Pat. No. 8,408,131 entitled "Energetic Material Initiation Device", which is incorporated by reference as if fully set forth in detail herein.

The housing assembly 12 can include a header assembly 20 and a housing member 22 that can cooperate to define an interior cavity 24 into which the exploding foil initiator 14, the input charge 16 and the output charge assembly 18 can be received. With specific reference to FIGS. 2 and 3, the header assembly 20 can include a header body 30, a plurality of terminals 32, a plurality of seals 34, an insulating spacer 36, a frame member 38, and a plurality of contacts 40. The header body 30 can define a plurality of terminal apertures 42 through which the terminals 32 can be received. Each of the seals 34 can be received in an associated one of the terminal apertures 42 and can be sealingly engaged to the header body 30 and an associated one of the terminals 32. The insulating spacer 36 can be disposed over an interior surface 46 of the header body 30. The frame member 38 can be disposed over the insulating spacer 36 on a side opposite the interior surface 46. The frame member 38 can define an aperture 48 that can be sized to receive the exploding foil initiator 14 therein. The terminals 32 can extend through the insulating spacer 36 and the frame member 38.

Figure 2:
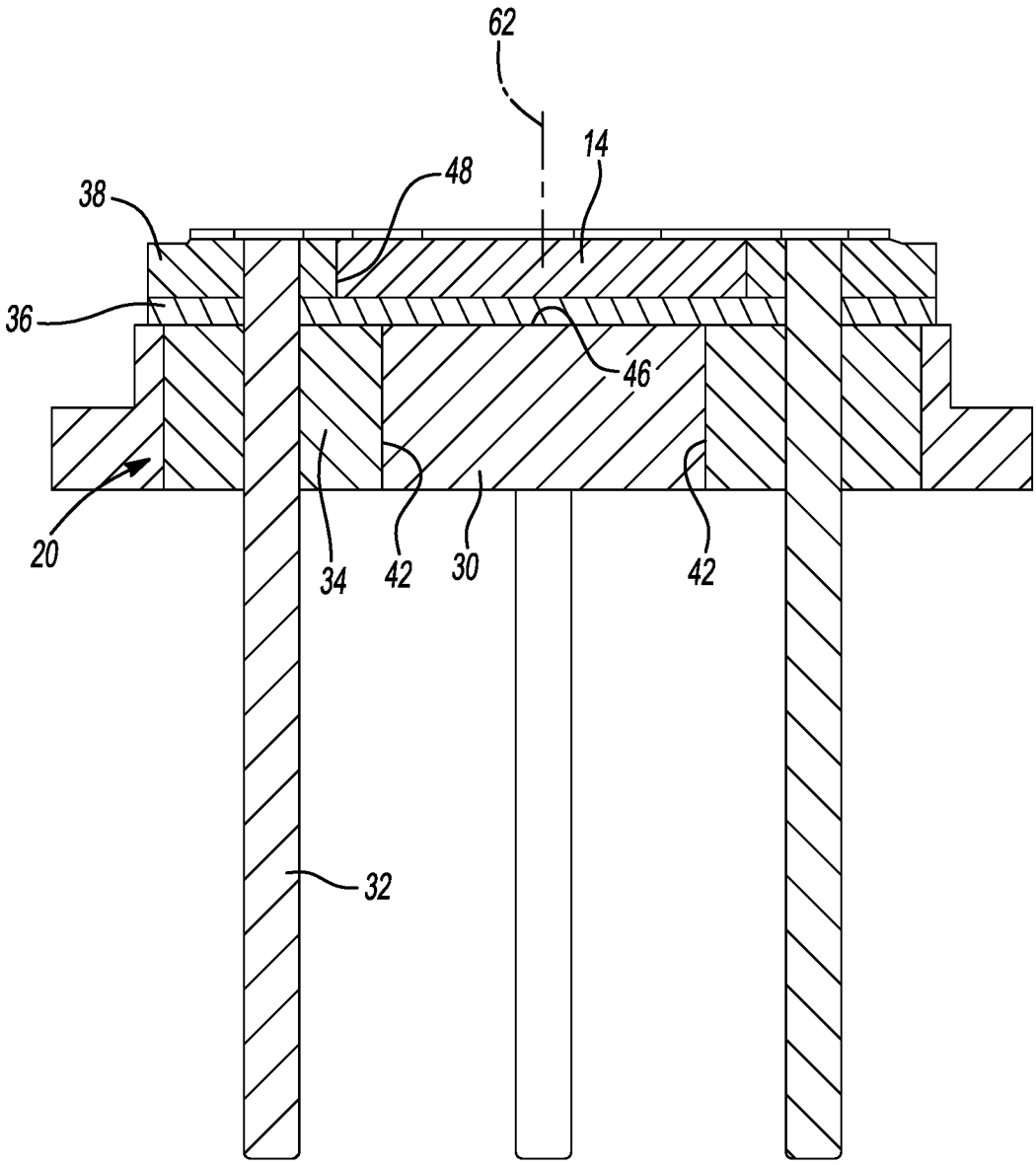
FIG. 2 is a longitudinal section view of a portion of the initiator assembly of FIG. 1, illustrating a header assembly in more detail.
Figure 3:
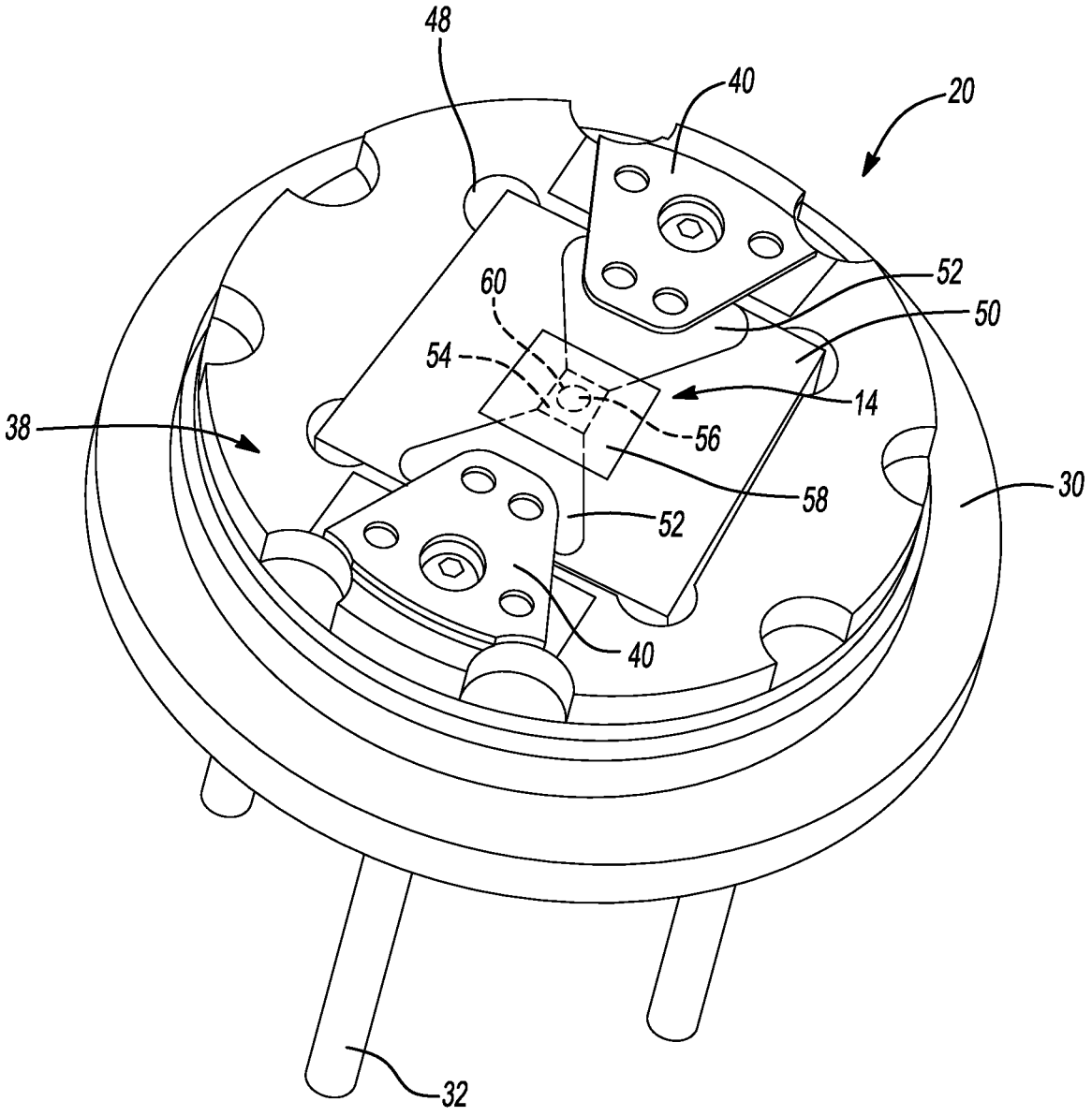
FIG. 3 is a perspective view of a portion of the initiator assembly of FIG. 1, illustrating the header assembly and an exploding foil initiator in more detail.

With specific reference to FIG. 3, the exploding foil initiator 14 can comprise a base 50, a plurality of bridge lands 52, a bridge 54, a flyer 56 and a barrel 58. The base 50 can be formed of a suitable structural and electrically insulating material, such as ceramic. The bridge lands 52 and the bridge 54 can be formed onto or otherwise secured to the base 50. The flyer 56 can be formed of a suitable material, such as a polyamide, and can be disposed over the bridge 54. The barrel 58 can be disposed over the flyer 56 on a side of the flyer 56 that faces away from the bridge 54. The barrel 58 can define a barrel aperture 60 having a longitudinal axis 62 (FIG. 2) that is disposed in-line with the flyer 56 and the bridge 54. Each of the contacts 40 can be electrically coupled to an associated one of the terminals 32 and an associated one of the bridge lands 52.

With reference to FIGS. 1 and 3, the input charge 16 can be formed of a suitable secondary explosive and can be disposed in-line with the barrel aperture 60 along the longitudinal axis 62 (FIG. 2). If desired, the input charge 16 can be retained in an annular sleeve 70 and an electrically insulating material 72 can be disposed between the contacts 40 and the annular sleeve 70. Optionally, a support member (not specifically shown) can be disposed between the contacts 40 and the input charge 16 as is described in commonly assigned U.S. patent application Ser. No. 15/490,358 filed Apr. 18, 2017 and entitled "Initiator Assembly That Is Resistant To Shock", which is incorporated by reference as if fully set forth in detail herein.

Figure 4:
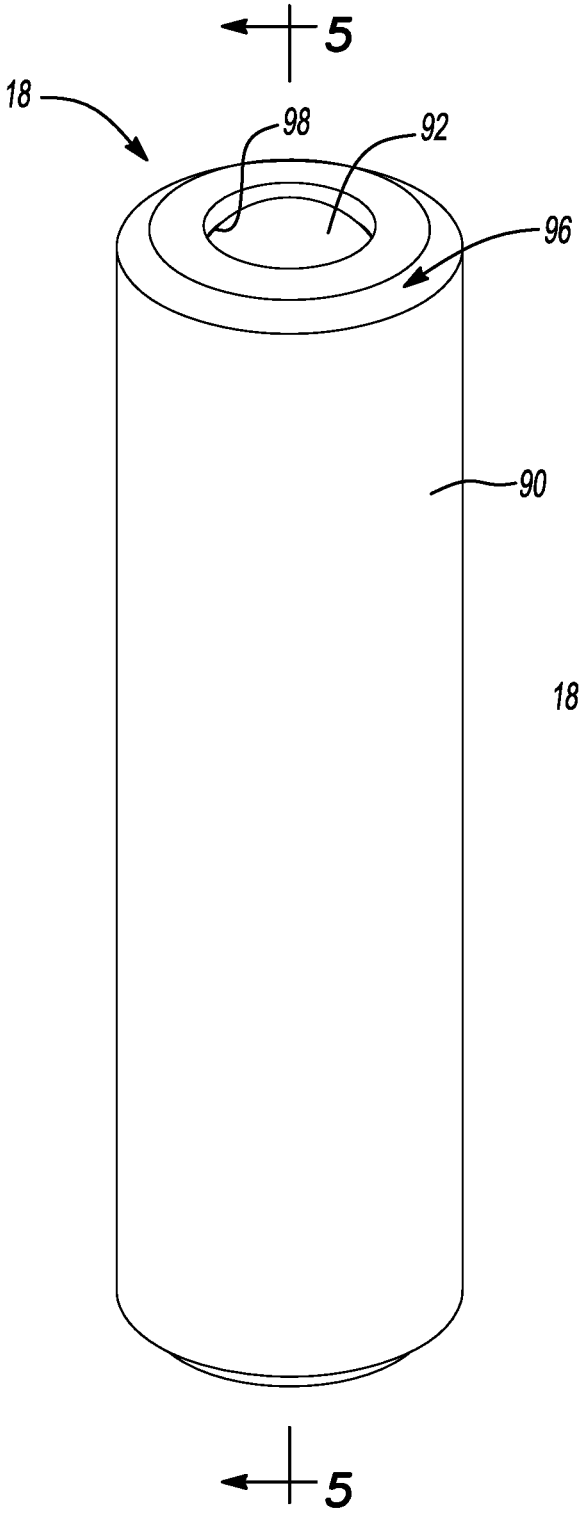
FIG. 4 is a perspective view of a portion of the initiator assembly of FIG. 1, illustrating an output charge assembly in more detail.
Figure 5:
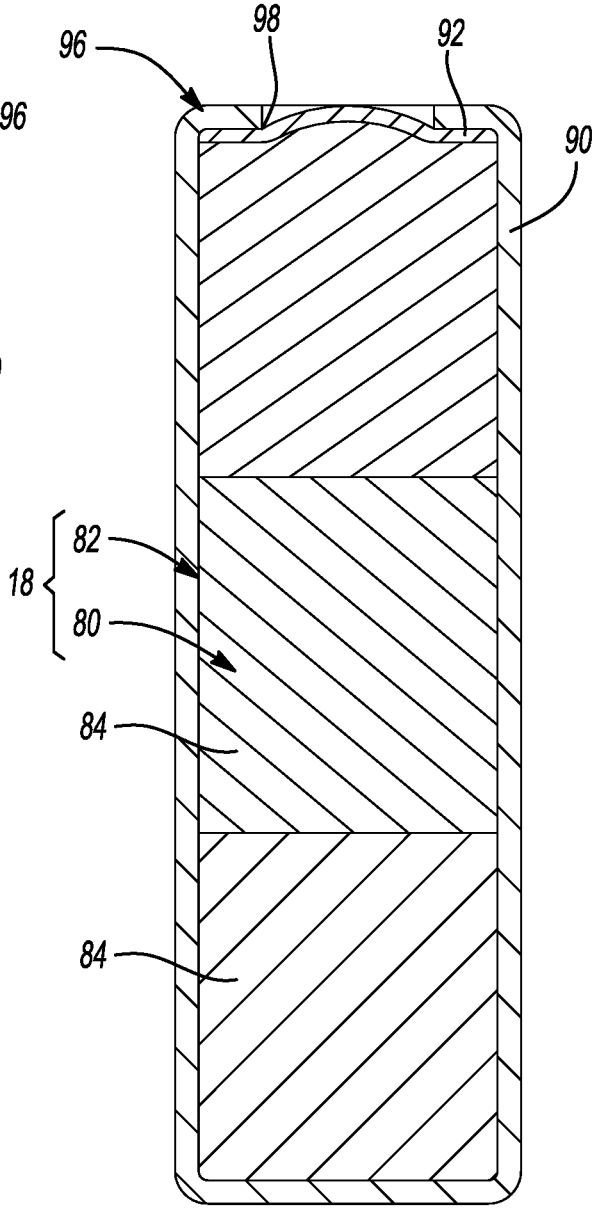
FIG. 5 is a longitudinal section view of the output charge assembly.

The output charge assembly 18 can be received in the interior cavity 24 and disposed in-line with the input charge 16 on a side of the input charge 16 that faces away from the exploding foil initiator 14. With reference to FIGS. 4 and 5, the output charge assembly 18 can include an output charge 80 and a container 82. The output charge 80 can be formed of a secondary explosive. The output charge 80 can be formed as one or more pellets 84 of a compacted powdered secondary explosive. If desired, each of the pellets 84 can be compacted along an axis that is parallel to (or coincident with) the longitudinal axis 62 (FIG. 2) of the barrel aperture 60.

The container 82 can define a closed volume into which the output charge 80 is received. In the example provided, the container 82 comprises a cup portion 90 and a lid portion 92. The cup portion 90 can be formed of a suitable material, such as a plastic or a metal (e.g., aluminum), in a suitable process, such as injection molding for plastics and drawing for metals. The output charge 80 can be received into the cup portion 90 and the lid portion 92 can be fixedly coupled to the cup portion 90 in a desired manner to secure the output charge 80 in the container 82. In the example provided, the lid portion 92 is received into the cup portion 90 over the output charge 80 and the cup portion 90 is deformed in a suitable manner, such as crimping (i.e., to form a crimp 96), to inhibit withdrawal of the lid portion 92 from the cup portion 90 and optionally to fixedly couple the lid portion 92 to the cup portion 90. It will be appreciated that other means may be employed for securing the lid portion 92 to the cup portion 90, including bonding. If desired, a force can be exerted through the container 82 to the output charge 80 during the assembly of the output charge assembly 18 that permits the container 82 to exert a compressive stress onto the output charge 80. The compressive stress could be directed along an axis that is coincident with the longitudinal axis 62 (FIG. 2) of the barrel aperture 60. Optionally, a sealant 98, such as a varnish, could be employed to seal the interface between the cup portion 90 and the lid portion 92.

With renewed reference to FIG. 1, it will be appreciated that placement of the output charge 80 in the container 82 isolates the output charge 80 from the exploding foil initiator 14 so that particles of the output charge 80 that may fragment from the remainder of the output charge 80 when the initiator assembly 10 experiences significant levels of vibration are maintained in the container 82 and cannot migrate through the interior cavity 24 and onto the flyer 56 (FIG. 3) where those particles may detrimentally affect the operation of the initiator assembly 10.

Figure 6:
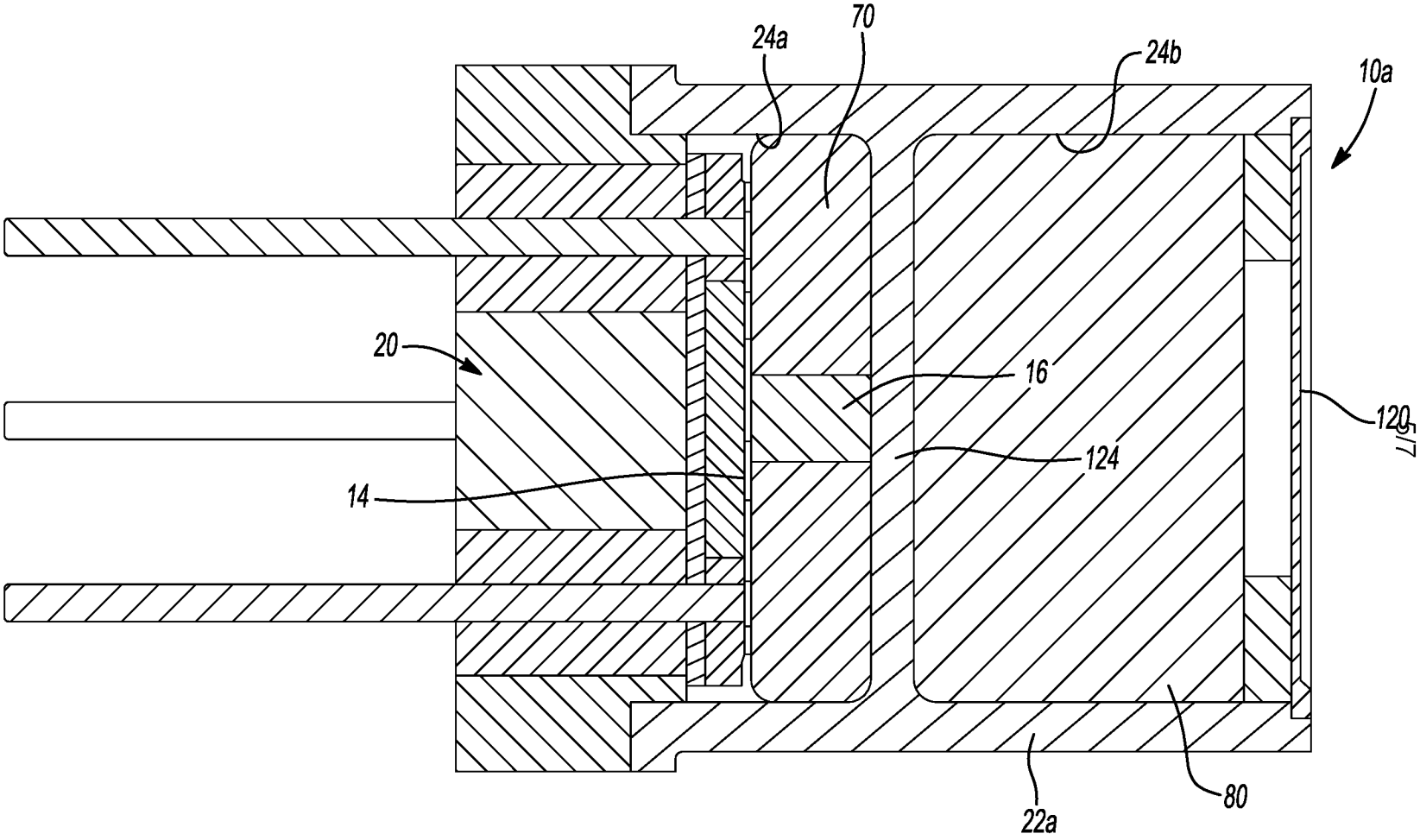
FIG. 6 is a longitudinal section view of a second initiator assembly constructed in accordance with the teachings of the present disclosure.
Figure 7:
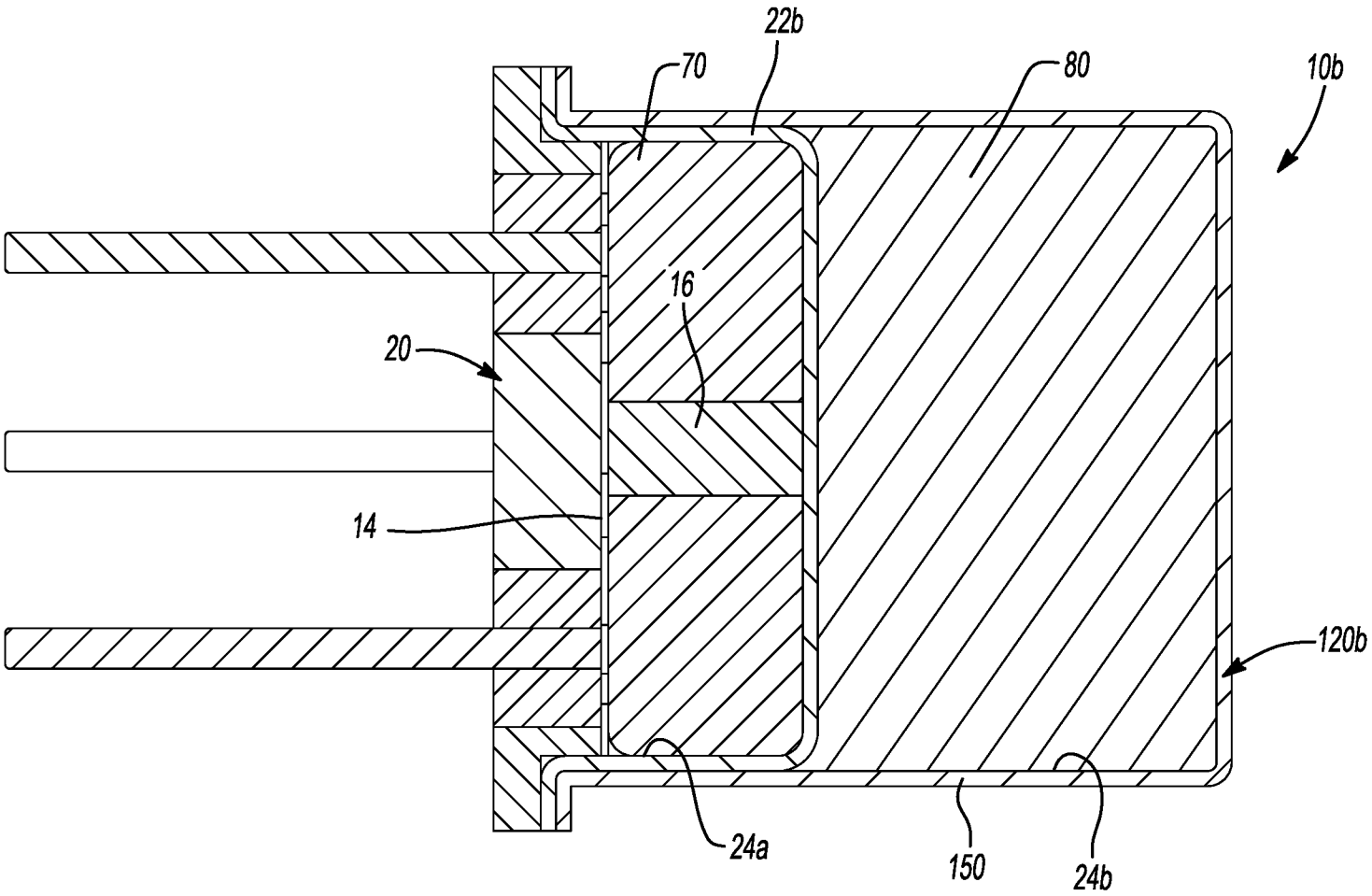
FIG. 7 is a longitudinal section view of a third initiator assembly constructed in accordance with the teachings of the present disclosure.
Figure 8:
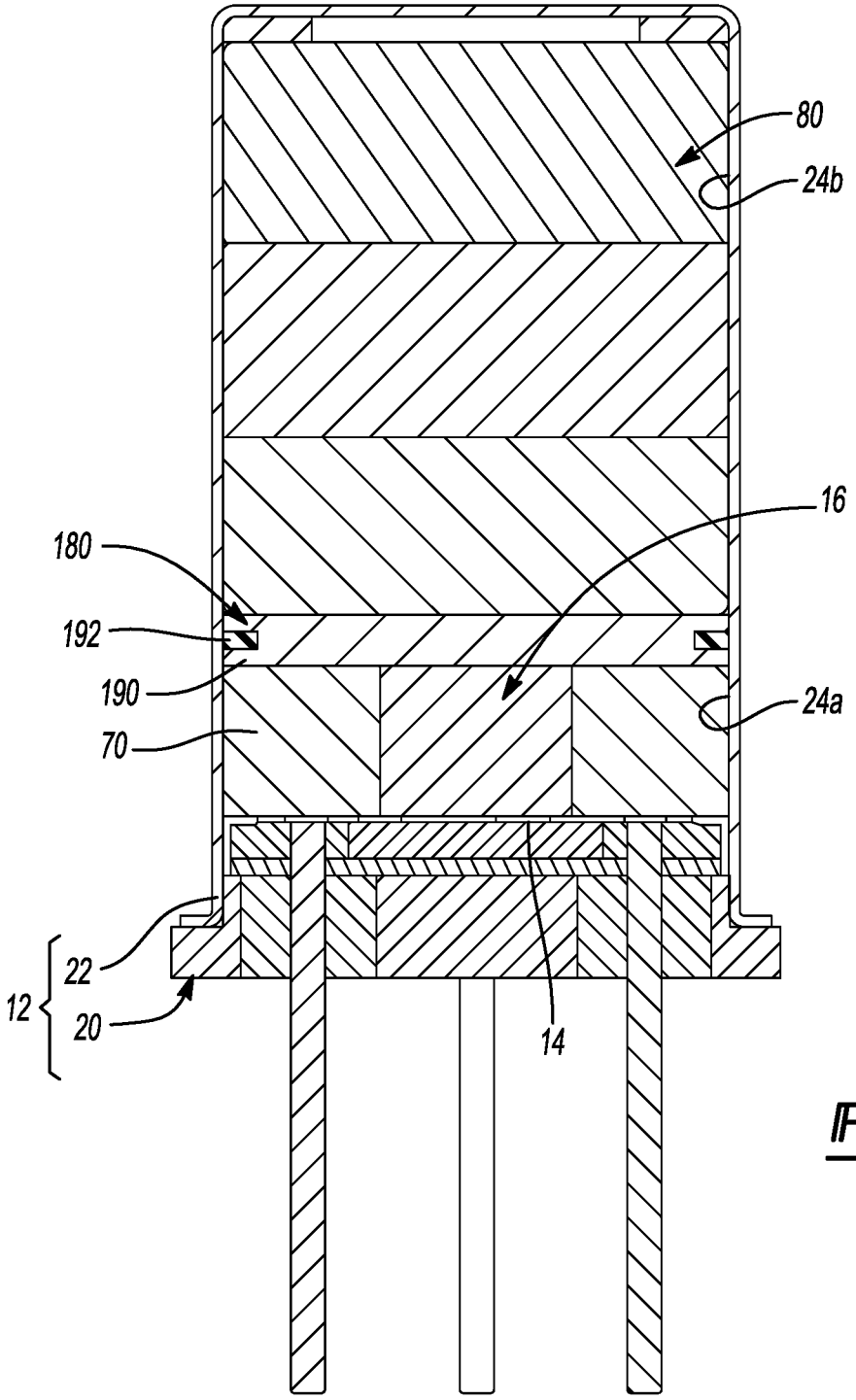
FIG. 8 is a longitudinal section view of a fourth initiator assembly constructed in accordance with the teachings of the present disclosure.

With reference to the examples of FIGS. 6 through 8, several other initiator assemblies constructed in accordance with the teachings of the present disclosure are depicted. In each of these examples, the initiator assembly depicted is generally similar to the initiator 10 (FIG. 1), except that the housing assembly defines a first cavity **24*a*, into which the exploding foil initiator 14 and the input charge 16 are received, and a second cavity 24*b* into which the output charge 80 is received, and the output charge 80 is not disposed in a container. In the example of FIG. 6, the housing assembly 12*a* of the initiator assembly 10*a* includes a header assembly 20, a housing member 22*a* and a lid member 120. The header assembly 20 and the housing member 22*a* can cooperate to form the first cavity 24*a*. The second cavity 24*b* can be formed (as a bore) into the housing member 22*a* on an end over the housing member 22*a* that faces away from the header assembly 20. The second cavity 24*b* can be configured to receive the output charge 80. The housing member 22*a* can have an internal wall 124 that separates the second cavity 24*b* from the first cavity 24*a*. The lid member 120 can be fixedly coupled to the housing member 22*a* to close the second cavity 24*b* to retain the output charge 80 in the second cavity 24*b* and segregate the output charge 80 from the first cavity 24*a*. In this particular example, the output charge 80** can only be formed of a secondary explosive.

In the example of FIG. 7, the initiator assembly **10*b* is similar to the initiator assembly 10*a* of FIG. 6, except that the lid member 120***b* has a cup-like body 150. The cup-like body 150 is configured to be received over the housing member member 22*b* so that the housing member 22*b* nests within the lid member 120*b*. In this example, some or all of the second cavity 24*b* can be formed by the lid member 120*b*. The cup-like body 150 can be secured to the housing member 22*b* or the header assembly 20 in a desired manner, such as laser welding. It will be appreciated that immediately prior to the securing of the lid member 120*b* to the housing member 22*b*, a force can be applied to the lid member 120*b* that tends to urge the lid member 120*b* in a direction toward the header assembly 20 to set the overall height of the initiator assembly 10*b* and/or to apply a compressive force to the output charge 80. The housing member 22*b* and the lid member 120*b* can be secured to one another to maintain the initiator assembly 10*b* at the set overall height and/or maintain the compressive force on the output charge 80.

The housing assembly 12*c* in the example of FIG. 8 is similar to the housing assembly 12 of FIG. 1, except that it includes a seal assembly 180 that segregates the interior cavity into the first and second cavities 24*a* and 24*b*. The seal assembly 180 is disposed along the longitudinal axis 62 (FIG. 2) of the barrel aperture 60 (FIG. 3) between the input charge 16 and the output charge 80 and is sealingly engaged to the housing member 22. The seal assembly 180 can include a body portion 190 and an annular seal member 192 that can be disposed about the body portion 190. The annular seal member 192 is configured to sealingly engage the body portion 190 and the interior surface of the housing member 22.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator assembly comprising:

a housing assembly that defines a first cavity, a second cavity, and a structural wall that separates and provides a hermetic seal between adjacent ends of the first and second cavities;

an exploding foil initiator received in the first cavity, the exploding foil initiator having a bridge, a flyer and a barrel, the flyer overlying the bridge and being disposed between the barrel and the bridge, the barrel defining a barrel aperture;

an input charge received in the first cavity and disposed in-line with the barrel aperture, the input charge being formed of a secondary explosive;

an output charge disposed in the second cavity and formed of a secondary explosive;

wherein the input charge is configured to detonate in response to receipt of kinetic energy of the flyer during operation of the exploding foil initiator, and wherein energy released from detonation of the input charge penetrates the structural wall and initiates detonation of the output charge.

2. The initiator assembly of claim 1, wherein the structural wall comprises a seal assembly and wherein the housing assembly includes a housing component into which the seal assembly is received, the seal assembly being disposed along the longitudinal axis of the barrel aperture between the input charge and the output charge, the seal assembly being sealingly engaged to the housing component.

3. The initiator assembly of claim 1, wherein the housing assembly includes a first housing structure, a second housing structure and a third housing structure, wherein the first and second housing structures are fixedly coupled to one another to form the first cavity, and wherein the second and third housing structures are fixedly coupled to one another to form the second cavity.

4. The initiator assembly of claim 1, further comprising a sleeve disposed about the input charge.

5. The initiator assembly of claim 1, wherein the output charge is formed as a single pellet that is formed of a compacted powdered material.

6. The initiator assembly of claim 1, wherein the housing assembly comprises a housing member and wherein the housing member defines the structural wall.

7. The initiator assembly of claim 6, wherein the housing assembly comprises a lid member that is fixedly coupled to the housing member to close the second cavity.

8. The initiator assembly of claim 7, wherein the lid member is bonded to the housing member.

9. The initiator assembly of claim 6, wherein the housing assembly includes a header assembly that is fixedly coupled to the housing member to close the first cavity.

10. The initiator assembly of claim 9, wherein the header assembly comprises a header body, a plurality of terminals received through the header body, and a plurality of seals that are sealingly engaged to the header body and an associated one of the terminals.

11. The initiator assembly of claim 10, wherein one of the housing member and the header body defines a shoulder and wherein the other one of the housing member and the header body is abutted to the shoulder.

12. The initiator assembly of claim 1, wherein the housing assembly comprises a housing member and wherein the structural wall is slidably disposed within the housing member.

13. The initiator assembly of claim 1, wherein the housing assembly comprises a header assembly, a housing member and a lid member, wherein the header assembly is coupled to the housing member to close the first cavity, wherein the housing member is coupled to the lid member to close the second cavity, and wherein the structural wall is unitarily and integrally formed with the housing member.

* * * * *